US008459846B2

(12) United States Patent
Tsao

(10) Patent No.: US 8,459,846 B2
(45) Date of Patent: Jun. 11, 2013

(54) HEAT-DISSIPATING DOWNLIGHT LAMP HOLDER

(75) Inventor: Chia-Tsung Tsao, Taipei (TW)

(73) Assignee: Artled Technology Corp., New Taipei (TW)

( * ) Notice: Subject to any disclaimer, the term of this patent is extended or adjusted under 35 U.S.C. 154(b) by 309 days.

(21) Appl. No.: 13/047,101

(22) Filed: Mar. 14, 2011

(65) Prior Publication Data

US 2012/0236575 A1 Sep. 20, 2012

(51) Int. Cl.
*F21V 29/02* (2006.01)
*F21V 29/00* (2006.01)

(52) U.S. Cl.
USPC ..... 362/373; 362/147; 362/294

(58) Field of Classification Search
USPC ..... 362/147, 294, 373
See application file for complete search history.

(56) References Cited

U.S. PATENT DOCUMENTS

| | | | | |
|---|---|---|---|---|
| 7,144,135 | B2 * | 12/2006 | Martin et al. | 362/294 |
| 7,677,770 | B2 * | 3/2010 | Mazzochette | 362/364 |
| 7,682,054 | B2 * | 3/2010 | Hsu et al. | 362/373 |
| 7,874,710 | B2 * | 1/2011 | Tsai et al. | 362/373 |
| 8,235,555 | B2 * | 8/2012 | Thomas et al. | 362/294 |
| 8,262,256 | B2 * | 9/2012 | Biebl et al. | 362/249.02 |
| 2009/0296414 | A1 * | 12/2009 | Moriyama et al. | 362/373 |

* cited by examiner

*Primary Examiner* — Stephen F Husar
*Assistant Examiner* — James Cranson, Jr.
(74) *Attorney, Agent, or Firm* — Pearne & Gordon LLP

(57) ABSTRACT

A heat-dissipating downlight lamp holder has a lamp holding unit, multiple fins and a bottom board. The fins are mounted on a periphery of the lamp holding unit to effectively dissipate heat of a light bulb mounted in the lamp holding unit out of the lamp holder. The bottom board located underneath the lamp holding unit has multiple air inlets formed through the bottom board to let cold air under the lamp holder enter the lamp holding unit through the air inlets. By convection, heat dissipated from the fins is carried away from the downlight, thereby effectively reducing heat accumulated by the light bulb and preventing the light bulb from being damaged by high heat.

20 Claims, 8 Drawing Sheets

HEAT-DISSIPATING DOWNLIGHT LAMP HOLDER

BACKGROUND OF THE INVENTION

1. Field of the Invention

The present invention relates to a lamp holder, and more particularly to a downlight lamp holder used for a light-emitting diode (LED) bulb and effectively dissipating heat generated by the LED bulb.

2. Description of the Related Art

Lighting is one of the great achievements in human history. Lighting enables human beings to conveniently move and work at night. Since the advent of the first light bulb, lighting devices have migrated from conventional incandescent light bulbs and fluorescent lamps to light-emitting diodes (LED) with high luminance and low power consumption.

Despite the mentioned advantages, LED has been found disadvantageous in generating high heat. If the temperature of LED is not controlled properly, the life cycle of LED will be significantly shortened. Although the implementation of LED with low heat generation is technically feasible, the cost of such current technical solutions is still high. On the other hand, conventional heat-dissipating devices are usually mounted outside the lamp holders, for example on the lamp holders. The heat-dissipating devices mounted on the lamp holders not only have an unsatisfactory cooling effect but also increase the overall size of the lamp holders. Based on the issues of the conventional lamp holders, the conventional lamp holders need to be further improved.

SUMMARY OF THE INVENTION

An objective of the present invention is to provide a downlight lamp holder used for LED bulbs and effectively dissipating heat generated by an LED bulb mounted inside the lamp holder.

To achieve the foregoing objective, the heat-dissipating downlight lamp holder has a bottom board, a lamp holding unit and a heat-dissipating unit.

The bottom board has a light exit hole and multiple air inlets. The light exit hole is centrally formed through the bottom board. The air inlets are formed through the bottom board and around the light exit hole.

The lamp holding unit is mounted on the bottom board and has an inner tube, an inner top cover and an outer top cover. The inner tube is tubular, is securely mounted on the bottom board, and has two openings, a top edge and a bottom edge. The openings are respectively formed through a top and a bottom of the inner tube. The top edge is formed around the opening in the top of the inner tube. The bottom edge is formed around the opening in the bottom of the inner tube. The bottom edge of the inner tube is mounted between the light exit hole and the air inlets. The inner top cover is mounted on the top edge of the inner tube and has a top. The outer top cover is mounted on the top edge of the inner top cover.

The heat-dissipating unit is mounted on the inner top cover and has multiple side fins securely mounted around a periphery of the inner tube.

The heat-dissipating downlight lamp holder is advantageous in that the side fins are mounted on a periphery of the lamp holding unit to effectively dissipate heat of a light bulb mounted in the lamp holding unit out of the lamp holder. The bottom board has multiple air inlets formed therethrough to let cold air under the lamp holder enter the lamp holding unit through the air inlets. Heat dissipated from the side fins is carried away from the downlight by convection, thereby effectively reducing heat accumulated by the light bulb and preventing the light bulb from being damaged by excessively accumulated heat.

Other objectives, advantages and novel features of the invention will become more apparent from the following detailed description when taken in conjunction with the accompanying drawings.

DETAILED DESCRIPTION OF THE INVENTION

Figure 1:
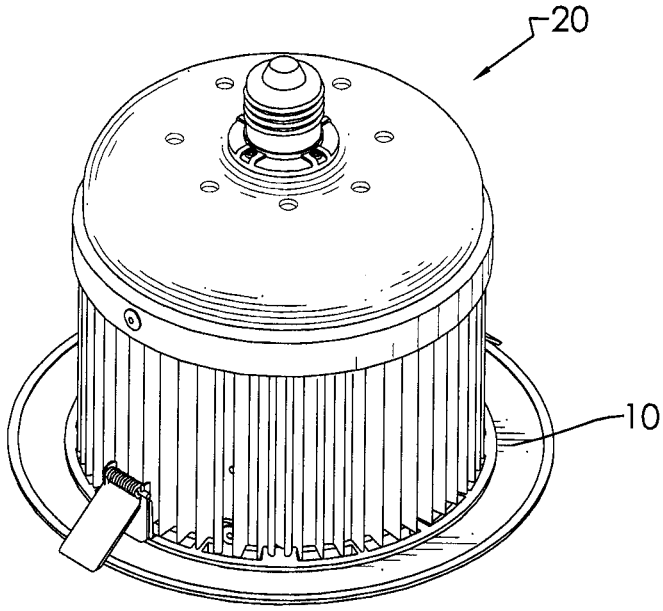
FIG. 1 is a perspective view of a first embodiment of a heat-dissipating downlight lamp holder in accordance with the present invention.
Figure 2:
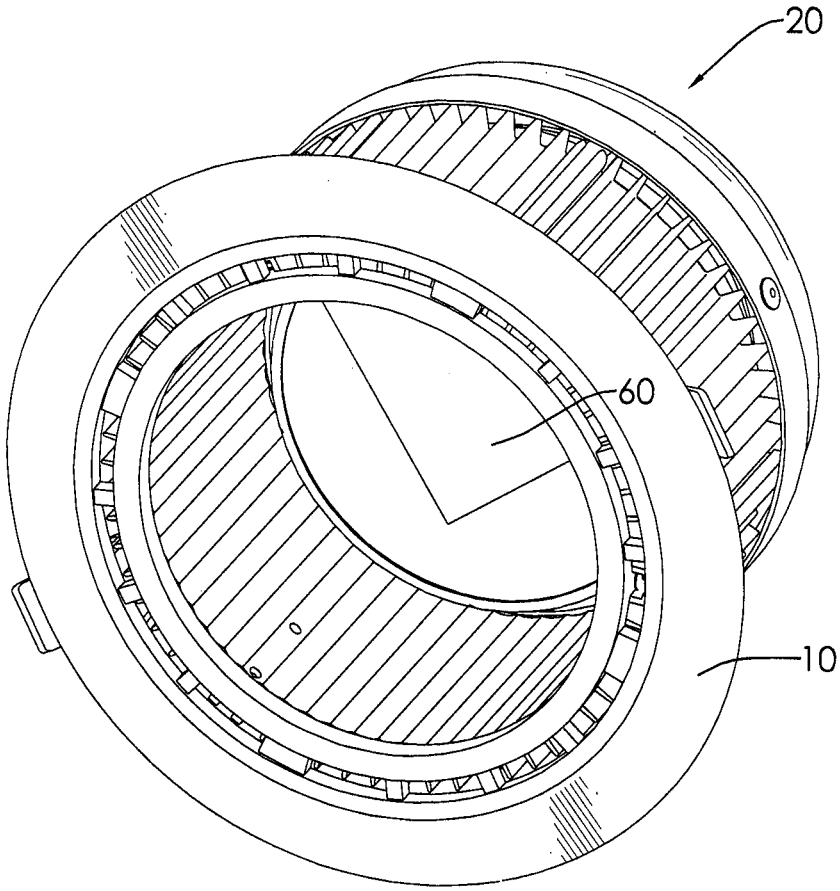
FIG. 2 is another perspective view of the heat-dissipating downlight lamp holder in FIG. 1.
Figure 3:
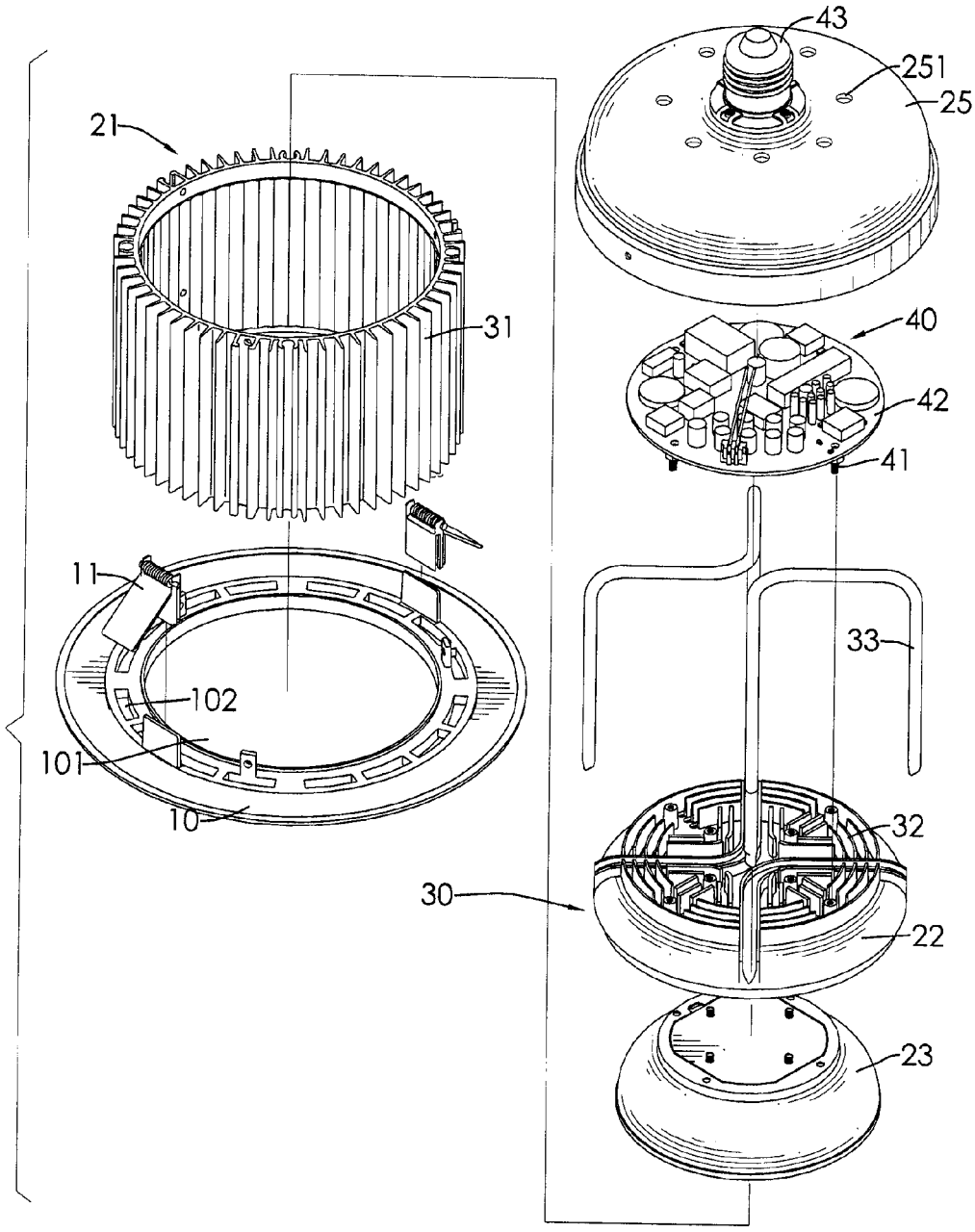
FIG. 3 is an exploded perspective view of the heat-dissipating downlight lamp holder in FIG. 1.

With reference to FIGS. 1 to 3, a first embodiment of a heat-dissipating downlight lamp holder in accordance with the present invention has a bottom board 10, a lamp holding unit 20 and a heat-dissipating unit 30.

The bottom board 10 is annular and has a light exit hole 101 and multiple air inlets 102. The light exit hole 101 is centrally formed through the bottom board 10. The air inlets 102 are formed through the bottom board 10 and around the light exit hole 101. In the present embodiment, the bottom board 10 further has two lower fixing elements 11 securely mounted on the bottom board 10.

The lamp holding unit 20 is mounted on the bottom board 10, and has an inner tube 21, an inner top cover 22 and an outer top cover 25. The inner tube 21 is tubular and has two openings, a top edge and a bottom edge. The openings are formed respectively through a top and a bottom of the inner tube 21. The top edge is formed around the opening in the top, and the bottom edge is formed around the opening in the bottom. The bottom board 10 is securely mounted on the bottom edge of the inner tube 21, and the bottom edge of the inner tube 21 is mounted between the light exit hole 101 and the air inlets 102. In the present embodiment, the perimeter of the opening in the bottom of the inner tube 21 coincides with the perimeter of the light exit hole 101. The inner top cover 22 is disc-shaped in cross section and mounted on the top edge of the inner tube 21. The outer top cover 25 is mounted on a top of the inner top cover 22. In the present embodiment, the lamp holding unit 20 further has a lampshade 23 securely mounted on a bottom of the inner top cover 22 and mounted in the inner tube 21. The outer top cover 25 has multiple air outlets 251 formed through a top of the outer top cover 25.

Figure 4:
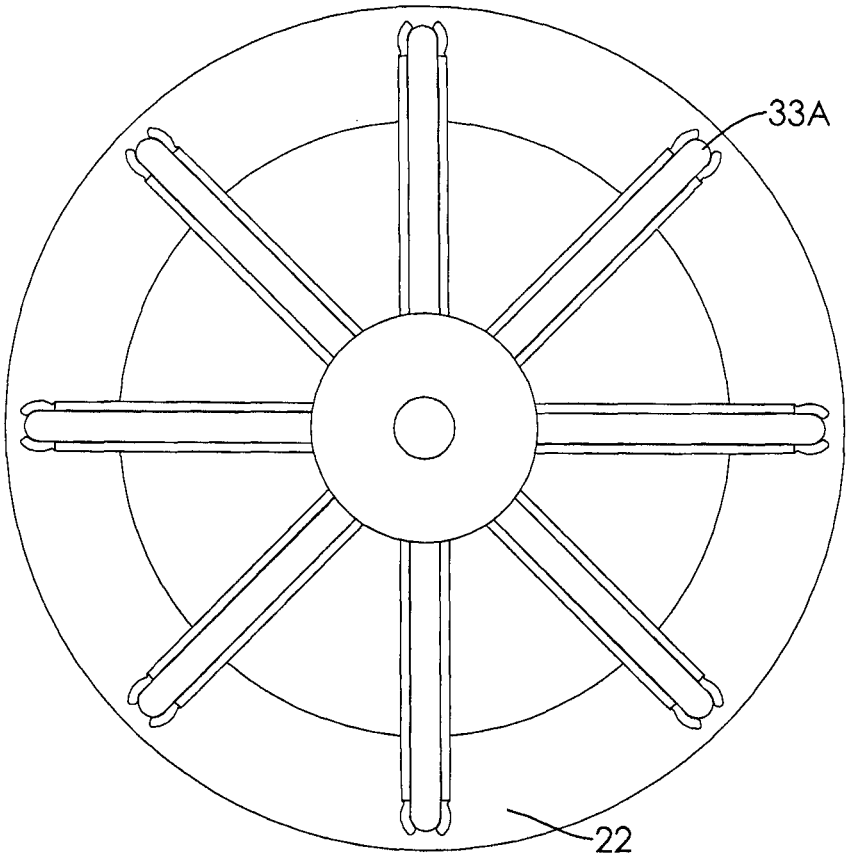
FIG. 4 is a top view of an alternative embodiment of a heat-dissipating unit with heat conduction tubes for the heat-dissipating downlight lamp holder in FIG. 1.
Figure 5:
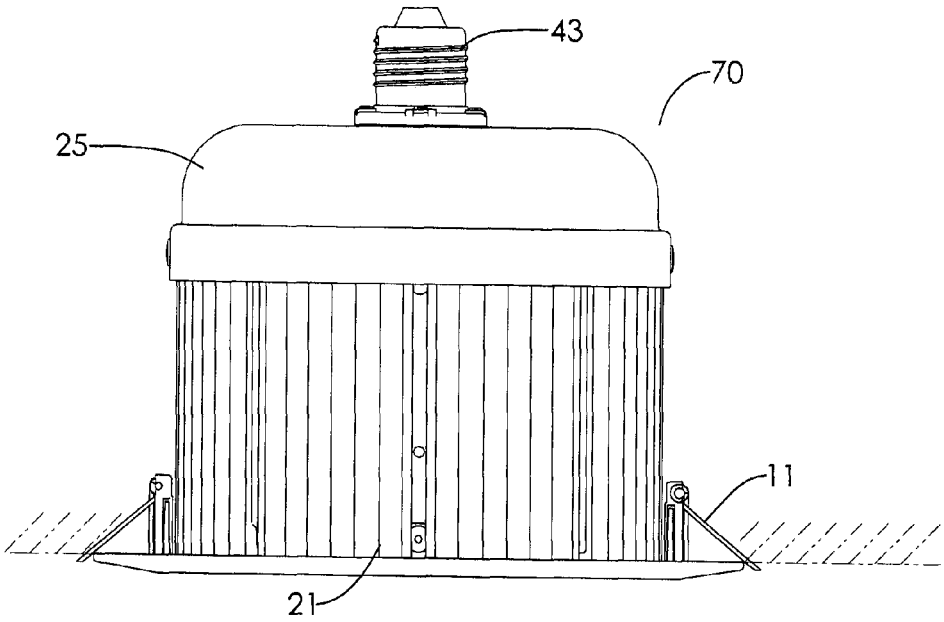
FIG. 5 is a side view of the heat-dissipating downlight lamp holder in FIG. 1 mounted on a ceiling.

The heat-dissipating unit 30 has multiple side fins 31, multiple top fins 32 and multiple heat conduction tubes 33. The side fins 31 are securely mounted around a periphery of the inner tube 21. In the present embodiment, the side fins 31 are integrally formed around the periphery of the inner tube 21. The top fins 32 are securely mounted on the top of the inner top cover 22. The top fins 32 may be integrally formed on the top of the inner top cover 22. The heat conduction tubes 33 are securely mounted on the top of the inner top cover 22, and extend to the periphery of the inner tube 21. Each heat conduction tube 33 is mounted between adjacent two of the top fins 32 on the inner top cover 22, and an end of each heat conduction tube 33 is mounted between adjacent two of the side fins 31. In the present embodiment, each heat conduction tube 33 has two integrally formed L-shaped bars. Each L-shaped bar has two segments. One segment of one L-shaped bar intersects with one segment of the other L-shaped bar in a V-shaped form. The other two segments of the two L-shaped bars are parallel. With reference to FIG. 4, an alternative example of the heat conduction tubes 33A is shown. The segments of the heat conduction tubes 33A mounted on the top of the inner top cover 22 are radially spaced apart from each other.

With reference to FIGS. 1 to 3 and 5, the downlight lamp holder in accordance with the present invention can be combined with an electronic component set 40 and an LED bulb 60 to form a downlight. The downlight can be mounted in a ceiling 70. The electronic component set 40 is mounted on the lamp holding unit 20, and has multiple circuit board supports 41, a circuit board 42 and a base 43. One end of each circuit board support 41 is securely mounted on the top of the inner top cover 22. The other end of each circuit board support 41 is securely mounted on a bottom of the circuit board 42. The base 43 is securely mounted on the top of the outer top cover 25 and is electrically connected with the circuit board 42. The LED bulb 60 is securely mounted on an inner side of the lampshade 23 and is electrically connected with the circuit board 42. The downlight lamp holder is fixed on the ceiling through the lower fixing elements 11. A power supply is connected with the base 43 to supply an operating power to the circuit board 42 and the LED bulb 60.

Figure 6:
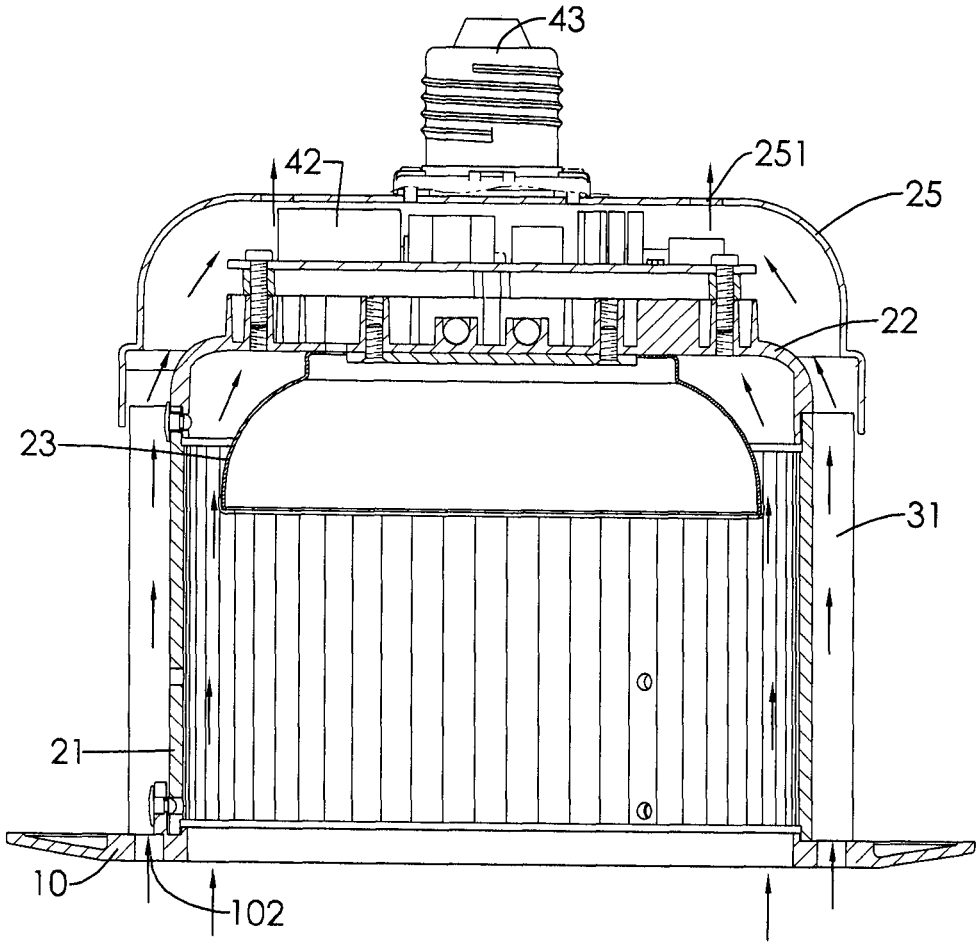
FIG. 6 is an operational side view in partial section of the heat-dissipating downlight lamp holder in FIG. 1.

With reference to FIGS. 3 and 6, when the downlight is operated, heat radiated from the LED bulb 60 is dissipated through the following three paths. The first path is that heat is transferred to the top fins 32 through the inner top cover 22. The second path is that heat is transferred to the heat conduction tubes 33 through the inner top cover 22, is then transferred to the periphery of the inner tube 21, and is further transferred to the side fins 31. The third path is that heat is transferred to the side fins 31 through the inner tube 21. Cold air enters the lamp holding unit 20 from the air inlets 102 of the bottom board 10, and sequentially carries away heat from the side fins 31 and the top fins 32 by convection and dissipates heat to the ceiling 70 through the air outlets 251 of the outer top cover 25, thereby effectively preventing heat from accumulating in the lamp holder.

Figure 7:
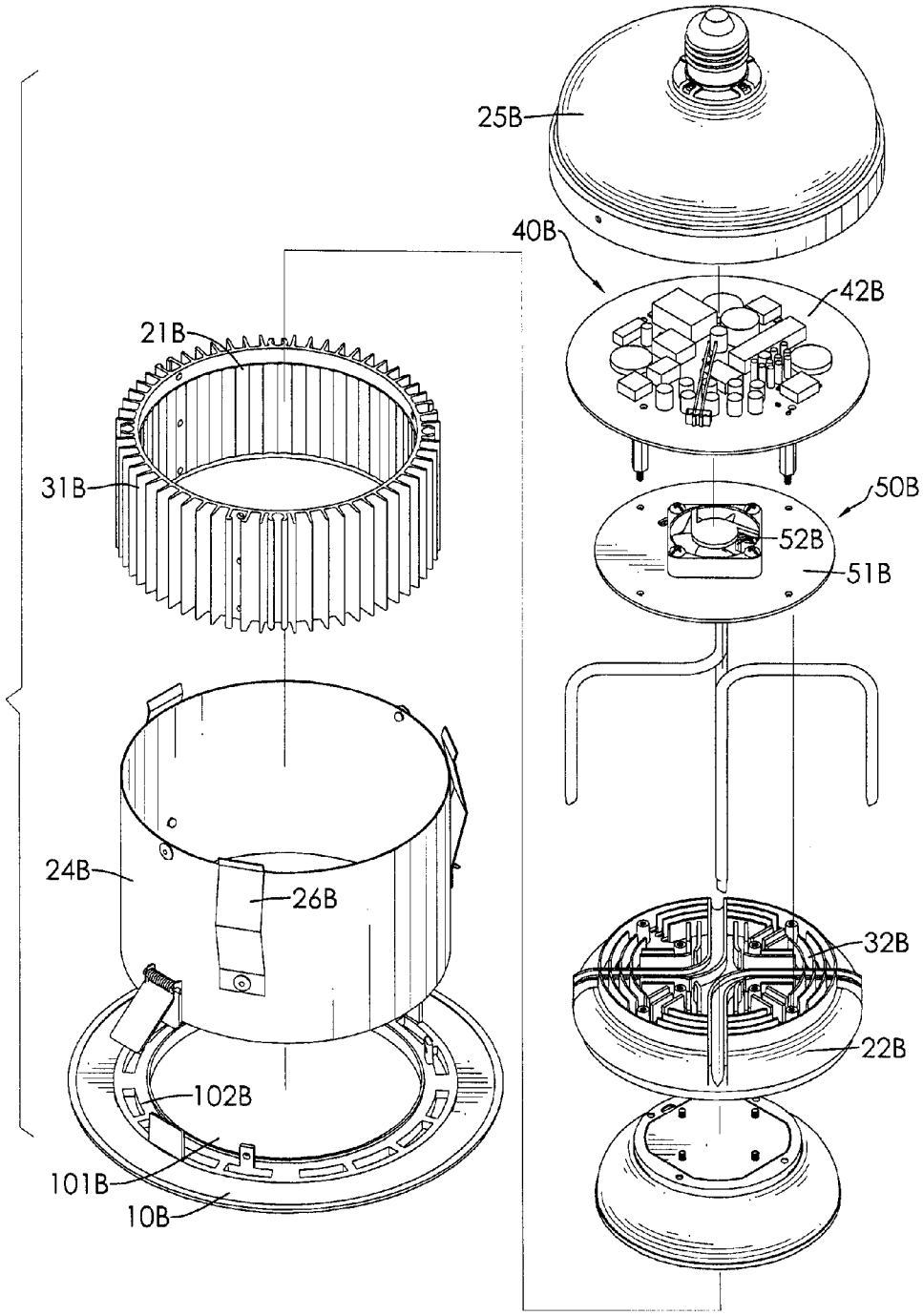
FIG. 7 is an exploded perspective view of a second embodiment of a heat-dissipating downlight lamp holder in accordance with the present invention.
Figure 8:
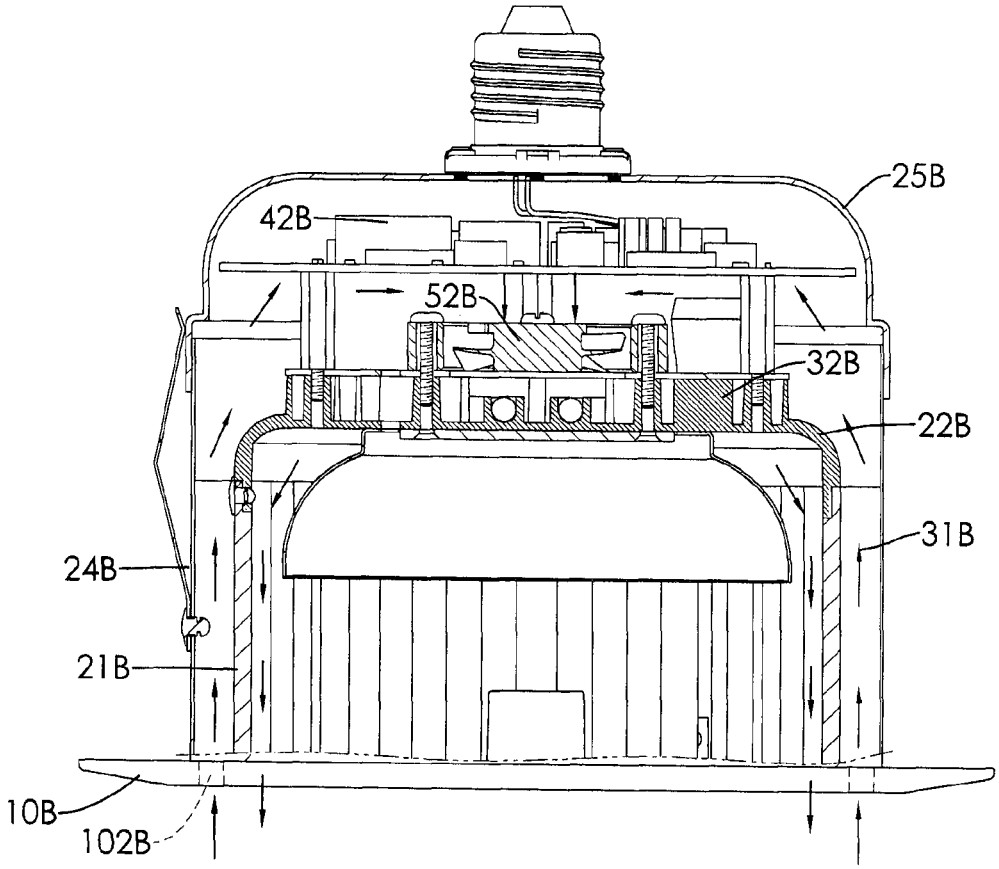
FIG. 8 is an operational side view in partial section of the heat-dissipating downlight lamp holder in FIG. 7.

With reference to FIGS. 7 and 8, a second embodiment of a downlight lamp holder in accordance with the present invention is similar to the first embodiment except that the second embodiment further has an outer tube 24B, multiple upper fixing elements 26B and a fan assembly 50B. The outer tube 24B is tubular, is securely mounted on the bottom board 10B, and has two openings, a top edge and a bottom edge. The openings are formed respectively through a top and a bottom of the outer tube 24B. The top edge is formed around the opening in the top, and the bottom edge is formed around the opening in the bottom. The outer tube 24B is mounted around the inner tube 21B. The bottom edge of the outer tube 24B surrounds the air inlets 102B. The outer top cover 25B is securely mounted on the top edge of the outer tube 24B. The upper fixing elements 26B are securely mounted on a periphery of the outer tube 24B. The fan assembly 50B is mounted between the inner top cover 22B and the outer top cover 25B, and has a fan tray 51B and a fan 52B. The fan tray 51B is securely mounted on the top of the inner top cover 22B. The fan 52B is securely mounted on the fan tray 51B and is electrically connected with the circuit board 42B of the electronic component set 40B.

When the downlight lamp holder is in use, the outer tube 24B surrounds the inner tube 21B and the inner top cover 22B to form an additional air flow passage for concentrating air flow. As the inner top cover 22B has some assembling holes unused when being assembled with the fan assembly 50B and there are slits formed through the top of the inner top cover 22B, the air blown out by the fan assembly 50B can enter the air flow passage formed between the inner top cover 22B and the inner tube 21B. The air flow circulation speed in the air flow passage is accelerated by operating the fan 52B. When the fan assembly is operating, cooling air enters from the air inlets 102B and is circulated through the air flow passage to sequentially carry away heat from the side fins 31B and the top fins 32B by convection, and the heated air is further blown out of the downlight lamp holder through the light exit hole 101B, thereby lowering heat accumulated inside the downlight lamp holder. Additionally, by using the upper fixing elements 26B, the downlight lamp holder can be more firmly mounted in a ceiling.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A heat-dissipating downlight lamp holder comprising:

a bottom board having:

a light exit hole centrally formed through the bottom board; and multiple air inlets formed through the bottom board and around the light exit hole;

a lamp holding unit mounted on the bottom board and having:

an inner tube being tubular, securely mounted on the bottom board, and having:

two openings respectively formed through a top and a bottom of the inner tube; and a top edge formed around the opening in the top of the inner tube;

a bottom edge formed around the opening in the bottom of the inner tube, wherein the bottom edge of the inner tube is mounted between the light exit hole and the air inlets;

an inner top cover mounted on the top edge of the inner tube and having a top; and an outer top cover mounted on the top edge of the inner top cover; and a heat-dissipating unit mounted on the inner top cover and having multiple side fins securely mounted around a periphery of the inner tube.

2. The heat-dissipating downlight lamp holder as claimed in claim 1, wherein the outer top cover has:

a top; and multiple air outlets formed through the top of the outer top cover.

3. The heat-dissipating downlight lamp holder as claimed in claim 1, wherein the lamp holding unit further has an outer tube being tubular, securely mounted on the bottom board and around the inner tube, and having:

two openings respectively formed through a top and a bottom of the outer tube;

a top edge formed around the opening in the top of the outer tube; and a bottom edge formed around the opening in the bottom of the outer tube and surrounding the air inlets; and the outer top cover is securely mounted on the top edge of the outer tube.

4. The heat-dissipating downlight lamp holder as claimed in claim 1, wherein the heat-dissipating unit further has multiple top fins mounted around the top of the inner top cover, and each top fin has a top edge.

5. The heat-dissipating downlight lamp holder as claimed in claim 2, wherein the heat-dissipating unit further has multiple top fins mounted around the top of the inner top cover, and each top fin has a top edge.

6. The heat-dissipating downlight lamp holder as claimed in claim 3, wherein the heat-dissipating unit further has multiple top fins mounted around the top of the inner top cover, and each top fin has a top edge.

7. The heat-dissipating downlight lamp holder as claimed in claim 1, wherein the heat-dissipating unit further has multiple heat conduction tubes securely mounted on the top of the inner top cover and extending to the periphery of the inner tube, and one end of each heat conduction tube is mounted between adjacent two of the side fins.

8. The heat-dissipating downlight lamp holder as claimed in claim 2, wherein the heat-dissipating unit further has multiple heat conduction tubes securely mounted on the top of the inner top cover and extending to the periphery of the inner tube, and one end of each heat conduction tube is mounted between adjacent two of the side fins.

9. The heat-dissipating downlight lamp holder as claimed in claim 3, wherein the heat-dissipating unit further has multiple heat conduction tubes securely mounted on the top of the inner top cover and extending to the periphery of the inner tube, and one end of each heat conduction tube is mounted between adjacent two of the side fins.

10. The heat-dissipating downlight lamp holder as claimed in claim 4, wherein the heat-dissipating unit further has multiple heat conduction tubes securely mounted on the top of the inner top cover, extending to the periphery of the inner tube and mounted through the top fins, and one end of each heat conduction tube is mounted between adjacent two of the side fins.

11. The heat-dissipating downlight lamp holder as claimed in claim 5, wherein the heat-dissipating unit further has multiple heat conduction tubes securely mounted on the top of the inner top cover, extending to the periphery of the inner tube and mounted through the top fins, and one end of each heat conduction tube is mounted between adjacent two of the side fins.

12. The heat-dissipating downlight lamp holder as claimed in claim 6, wherein the heat-dissipating unit further has multiple heat conduction tubes securely mounted on the top of the inner top cover, extending to the periphery of the inner tube and mounted through the top fins, and one end of each heat conduction tube is mounted between adjacent two of the side fins.

13. The heat-dissipating downlight lamp holder as claimed in claim 1, further comprising a fan assembly mounted on the top of the inner top cover.

14. The heat-dissipating downlight lamp holder as claimed in claim 2, further comprising a fan assembly mounted on the top of the inner top cover.

15. The heat-dissipating downlight lamp holder as claimed in claim 3, further comprising a fan assembly mounted on the top of the inner top cover.

16. The heat-dissipating downlight lamp holder as claimed in claim 4, further comprising a fan assembly mounted on the top of the inner top cover and on the top edges of the top fins.

17. The heat-dissipating downlight lamp holder as claimed in claim 5, further comprising a fan assembly mounted on the top of the inner top cover and on the top edges of the top fins.

18. The heat-dissipating downlight lamp holder as claimed in claim 6, further comprising a fan assembly mounted on the top of the inner top cover and on the top edges of the top fins.

19. The heat-dissipating downlight lamp holder as claimed in claim 7, further comprising a fan assembly mounted on the top of the inner top cover.

20. The heat-dissipating downlight lamp holder as claimed in claim 8, further comprising a fan assembly mounted on the top of the inner top cover.

* * * * *